US007278836B2

(12) United States Patent
Hammonds

(10) Patent No.: US 7,278,836 B2
(45) Date of Patent: Oct. 9, 2007

(54) METERING PUMP

(75) Inventor: Carl L. Hammonds, Humble, TX (US)

(73) Assignee: Hammonds Technical Services, Inc., Houston, TX (US)

( * ) Notice: Subject to any disclaimer, the term of this patent is extended or adjusted under 35 U.S.C. 154(b) by 835 days.

(21) Appl. No.: 10/676,184

(22) Filed: Oct. 1, 2003

(65) Prior Publication Data

US 2004/0076534 A1 Apr. 22, 2004

Related U.S. Application Data

(60) Provisional application No. 60/415,360, filed on Oct. 1, 2002, provisional application No. 60/423,320, filed on Oct. 31, 2002.

(51) Int. Cl.
*F04B 4/00* (2006.01)

(52) U.S. Cl. ..... 417/515; 417/531; 417/539

(58) Field of Classification Search ..... 417/338, 417/419, 515, 516, 517, 531, 539; 92/98 D
See application file for complete search history.

(56) References Cited

U.S. PATENT DOCUMENTS 582,256 A * 5/1897 Berrenberg ..... 417/515
855,504 A 6/1907 Davis
869,246 A 10/1907 Jones
1,774,662 A * 9/1930 Parks ..... 417/515
1,909,955 A * 5/1933 Herbsman et al. ..... 417/515
2,675,946 A * 4/1954 Strempel ..... 417/515
3,771,918 A * 11/1973 Winter ..... 417/319
4,060,178 A 11/1977 Miller
4,273,261 A 6/1981 Krueger
4,693,397 A 9/1987 Lang
4,773,305 A * 9/1988 Nissels ..... 92/98 D
4,865,226 A 9/1989 Becker et al.
4,883,409 A * 11/1989 Strohmeier et al. ..... 417/43
5,269,659 A * 12/1993 Hampton et al. ..... 417/43
5,772,899 A * 6/1998 Snodgrass et al. ..... 222/52
5,921,951 A * 7/1999 Morris ..... 417/307
6,527,518 B2 * 3/2003 Ostrowski ..... 417/40

* cited by examiner

*Primary Examiner*—Michael Koczo, Jr.
(74) *Attorney, Agent, or Firm*—Gary L. Bush; Mark D. Shelley, II; Andrews Kurth LLP

(57) ABSTRACT

A metering pump that is capable of delivering a constant, rate of fluid over a wide range of viscosities at infinitely variable delivery rates. Two identical pumping chambers are provided with one operating in the suction mode, and the other in the discharge mode with each cylinder switching modes at each pumping cycle, thereby providing continuous delivery of fluid in and out of the pump. The displacement of the chamber is large in order to facilitate operation at a very slow cycle speed of only one to four reciprocations per minute. The fluid valves are mechanically operated providing for positive sealing thus enabling the pump to operate at very slow speeds without leakage.

15 Claims, 7 Drawing Sheets

METERING PUMP

CROSS REFERENCE TO RELATED APPLICATION

This application is based upon provisional applications 60/415,360 filed on Oct. 1, 2002 and 60/423,320 filed on Oct. 31, 2002, the priorities of which are claimed.

BACKGROUND OF THE INVENTION

1. Field of the Invention

This invention relates generally to pumps and in particular to metering pumps.

2. Description of the Prior Art

Fluid metering is used in virtually every process where liquids are either mixed or used for specific purposes in manufacturing or various processes. Accuracy and consistency is important, because the efficacy of the process may be affected if the exact amount of additive liquid chemical is not applied to a process stream or process reservoir of liquid. Further, the cost of various chemicals that are blended or metered may be quite high, so for a system to be cost effective, the process of metering must be accurate. Additionally, metering or blending of various chemicals into process streams or process reservoirs must be consistent. Slugging or injecting with intermittent pulses is not desirable, because the consistency of the final mixture varies with uneven delivery of the injected fluid.

Additives for all types of motor and aviation fuels, additives for sanitizing water, additives for oilfield production and pipeline delivery are only a few of the many applications where consistent, accurate metered injection of various liquids is required.

Prior art metering pumps have included high speed reciprocating devices that utilize diaphragms, pistons or plungers as a means for moving the fluid and rely on check valves located on the suction and discharge side of the pumping chamber to isolate the suction from the discharge cycle. Such pumps usually have small displacement, and rely on the movement of fluid to aid in closing and opening the check valves on the suction and discharge side of the pump.

Any leakage of the valves whatsoever compromises the accuracy and consistency of the pump. Slow movement of such pumps is disadvantageous, because slow moving fluid reduces the amount of fluid energy available to seal or seat the valves. As a result, most such pumps run at relatively high speed. Some diaphragm pumps may only cycle periodically, but the pumping speed during that cycle is very fast in order to effect good valve sealing.

Such low-volume, high-speed pumps share common problems. They tend to cavitate if operated with less than ideal suction conditions. Changes in fluid viscosity are also a problem, because such pumps usually have small passageways and valves that are easily clogged or become less efficient when heavier fluids are introduced. Some fluids become more viscous when temperatures are lowered, making it difficult to hold injection ratios over a wide range of operating speed and temperature.

Another common problem with prior art metering pumps is loss of efficiency due to cavitation or leakage through poorly seated valves.

Another problem is the lack of precise control over delivered flow rates.

Another problem of prior metering pumps is in the complexity of piping between reservoir and pump along with potential problems arising from friction loss in pipe and fittings.

Another problem of prior metering pumps is that when used with certain chemicals and when subjected to a negative pressure, such as in suction lift applications, the liquid chemical goes through a phase change to gas, causing the pump to lose its prime, or pump with less efficiency.

Another problem of prior metering pumps is the fact that the pump is usually mounted outside of the fluid tank requiring separate mountings for the pump and tank, requiring connecting pipe and fittings between the pump and tank with the chance of inducing air into the suction of the pump and ineffectiveness due to friction loss of flow through the fittings or connecting pipes or tubing.

IDENTIFICATION OF OBJECTS OF THE INVENTION

A primary object of the invention is to provide a large, very slow operating mechanically operated valve with submerged suction that allows a pump to operate at virtually any speed from zero to maximum while eliminating loss of efficiency of prior valves due to cavitation or leakage through their poorly seated valves.

Another object of the invention is to provide a pump with much greater control of the delivered fluid by powering the pump with a motor with precise control of its speed of rotation.

Another object of the invention is to provide a metering pump which can be simply installed.

Another object of the invention is to provide a pump with pumping chambers of any stroke length or diameter.

Another object of the invention is to provide a positive displacement pump which is capable of accurately metering various liquids of widely varying viscosities.

Another object of the invention is to provide a metering pump that can operate at very slow rates and can be precisely controlled by varying the speed thereof with a driving motor.

Another object of the invention is to provide in a single pump the capability for operation at fractions of an ounce per minute to as much as several gallons of flow per minute with great accuracy.

Another object of the invention is to provide a metering pump that can handle various fluids that may contain entrained solids and contaminants.

Another object of the invention is to provide a pump that operates on mobile equipment where either air or electricity is available.

Another object of the invention is to provide a pump suitable for control by a variety of means such as flow meters or PLC's (programmable logic controllers).

Another object of the invention is to reduce or eliminate the problem of various fluids becoming air-locked within the pumping head due to boiling, off gassing, or entrained gas within the fluid being pumped.

Another object of the invention is to reduce the amount of piping and fittings necessary in feeding a metering pump with fluid.

SUMMARY OF THE INVENTION

The objects identified above as well as other features and advantages of the invention are incorporated in a positive displacement pump designed to accurately meter various liquids of widely varied viscosities. The device can operate at very slow rates and be controlled precisely by varying the speed of a driving DC stepper motor.

The pump includes two matching reciprocating pumping pistons in two chambers that are typically large in displacement. The pistons are reciprocated by matching lead screws or ball screw assemblies, each of which receive motive force from a gear box that turns each screw at precisely the same speed, but in opposite directions. The reciprocating pistons change direction at precisely the same time, each alternating between suction and discharge cycles. In this way, one piston/chamber is always delivering fluid while the other piston/chamber is always receiving fluid thereby, providing continuous, pulse-free delivery of metered fluid. Since switching from the suction to discharge cycle is instantaneous, an imperceptible interruption in flow is realized.

The pump is controlled to allow very low to very high flow rates by a mechanically operated check valve assembly that is positive and leak free, as contrasted with fluid actuated valves provided on most prior positive displacement pumps. The valves are characterized by large orifices that enable passing of solids without clogging. Soft seat elastomers and hard seat valves are provided for positive closing without a tendency to leak when entrapped solids are present in the fluid. As a result, pump efficiency is not affected by the presence of contaminants that clog or disable prior conventionally-sealed pumps.

The pump also includes tubular diaphragms that can be longer in stroke than the effective diameter. The diaphragm is a flexible molded tube that can be made with or without reinforcement in virtually any length. Each tube diaphragm is sealed and fastened at each end and is folded into itself to form a single convolution, the length of which varies with the piston stroke. As a result, pumping chambers of any stroke length or diameter can be provided. This design eliminates wear and leakage which are characteristics of plungers with packing or pistons with piston seals or rings. The tubular diaphragm has no wearing parts which are prone to leak with age and movement. The diaphragm operates at 100% efficiency until it fails. There is no leakage or bypass.

The pump according to the invention is preferably mounted with the suction end in the fluid reservoir thereby simplifying installation. As a result, piping between reservoir and pump, as in prior pump designs, is eliminated along with problems which arise from fluid flow friction loss in pipe and fittings.

The pump is driven by a 12 VDC high resolution current stepping motor. The output of the pumping chambers is directly related to pump stroke length, and stroke length is precisely controlled by actuation of timed lead screws. A computer for the pump is programmed to instruct the stepping motor to make a specific number of steps or revolutions. As a result, the pumping chambers are precisely advanced and a pre-determined amount of fluid is delivered. Such pre-determined amounts of fluid can be repeated by instructing the motor to repeat the number of steps or revolutions. Thus, fluid delivery from the pump has an accuracy similar to that of lead screw advancement in numerically-controlled machine tools. Rather than advancing cutting tools, the lead screws advance pumping pistons, plungers or diaphragms, thus displacing a precise quantity of fluid.

The pumping chambers and fluid control valve assembly are disposed inside the fluid chamber or tank. As a result, the inlet of the pump is submerged in the fluid, making it extremely unlikely that air from outside of the tank is introduced into the pump. Also, since the pump is submerged in the fluid of the tank, no negative pressure due to off-gassing of the fluid at the intake of the tank occurs.

BRIEF DESCRIPTION OF THE DRAWINGS

The invention is described in detail hereinafter on the basis of the embodiments illustrated in the accompanying figures, of which.

DESCRIPTION OF THE PREFERRED EMBODIMENT OF THE INVENTION

Figure 1:
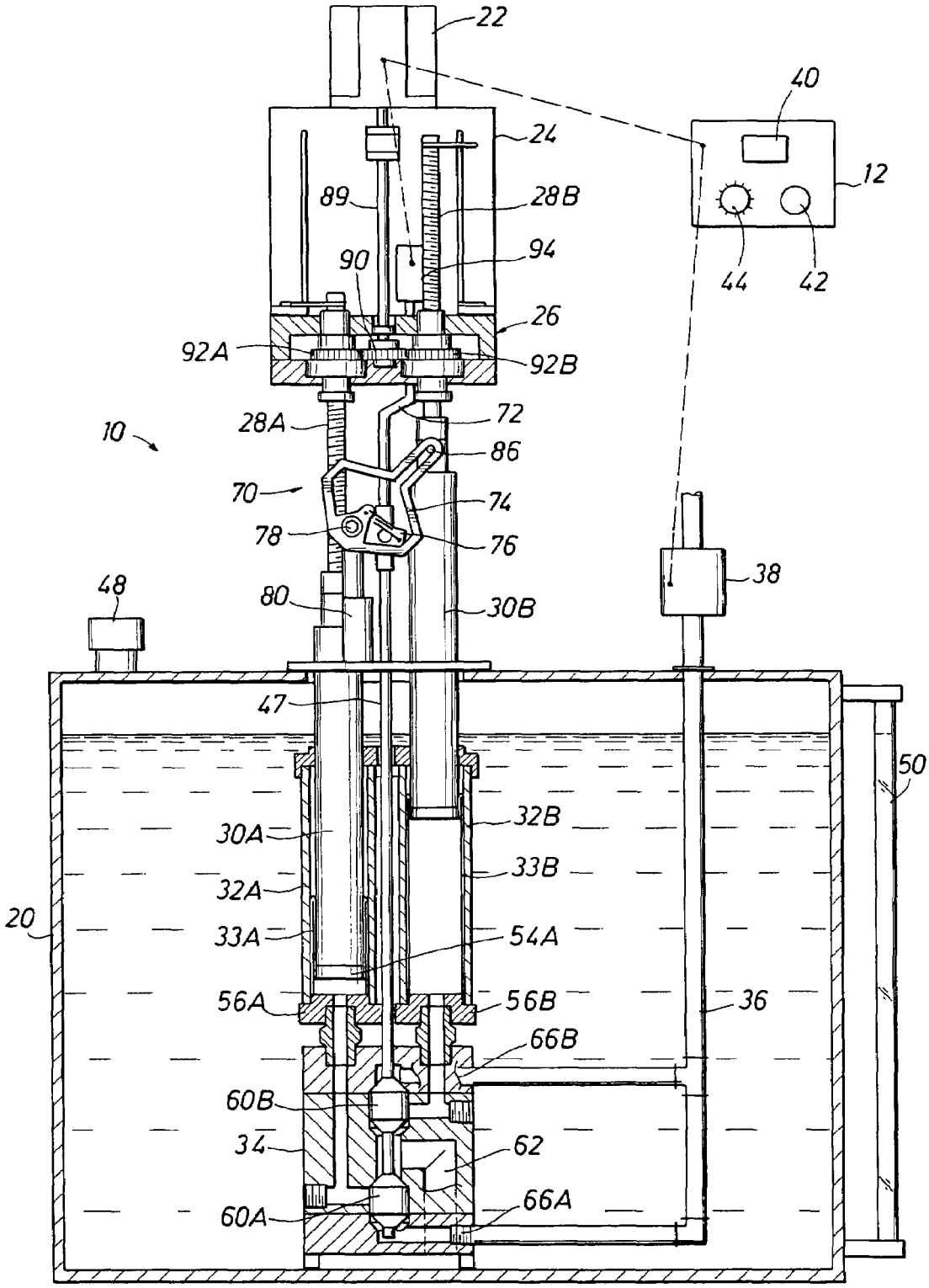
FIG. 1 illustrates a pump according to the invention installed in a fluid reservoir with a metering system and remotely mounted computer processor enabled controller for measuring, reporting and recording the performance of the pump.

FIG. 1 illustrates a dual chamber metering pump 10 of the invention as assembled in a fluid tank 20. A 12 VDC stepping motor 22 is mounted on an enclosure 24 which contains a reversing switch mechanism 94. Motor 22 drives input shaft 89 and drive gear 90 of gear box 26. Gears 92A, 92B are driven at the same speed and direction of rotation by gear 90. Lead screws 28A and 28B are vertically driven by threads within gears 92A, 92B and move in opposite directions by virtue of opposite-hand threads. The lead screws 28A, 28B are secured to pistons 30A, 30B in chambers 32A, 32B, respectively, mounted on top of valve body 34. Tubular diaphragms 33A, 33B are coupled between the lower ends of pistons 30A, 30B and the lower ends of cylinders 32A, 32B to form a vapor-tight seal.

Motor 22, enclosure 24 and gearbox 26 form the driving (or dry) end of pump 10, and the cylinders 32A, 32B, pistons 30A, 30B and the valve body 34 located within tank 20 form the pumping (or wet) end. Linkage 47, actuated at the dry end of pump 10, extends down to the valve body 34 to valves 60B, 60A to open and shut ports within the valve body in synchronism with the movement of pistons 30A, 30B to effect a pumping action. The linkage 47 is actuated by means of a snap-action automatic switching mechanism 70, which also toggles reversing switch 94 via linkage 72. Reversing switch 94 is coupled to motor 22 as indicated by dashed lines between motor 22 and switch 94. When the switch is activated, the shaft 89 turns in an opposite direction from its previous rotation direction. By adding extensions to lead screws 28A, 28B and to valve actuation linkage 47, the dry end may be raised to any suitable height above tank 20. This feature makes pump 10 adaptable to a variety of tanks 20 and installations.

Cylinders 32A, 32B are submerged in fluid tank 20 thereby providing flooded suction at inlet 62 at all times.

Fluid is delivered to the pumping chambers 32A, 32B through spool valves 60A, 60B. Output flow or discharge of the pump 10 exits alternating through one of spool valves 60A, 60B into common line or discharge manifold 36 and through meter 38 where flow rate of pumped fluid is measured. The tank shown in FIG. 1 also includes a fill spout 48 and a sight glass 50. A dotted line from meter 38 to panel 12 indicates that a flow rate signal to a computer program can provide a closed loop feedback system for precisely controlling the rate of fluid being pumped.

The remotely mounted panel 12 houses a programmed computer processor, a digital display 40, a reset button 42 and an additive monitoring light 44. Panel 12 accepts input data from meter 38 as to flow rate, and a computer program in the computer process determines whether to speed up or slow down the motor 22 to achieve a desired flow rate and the duration for a particular metering application.

Figure 2:
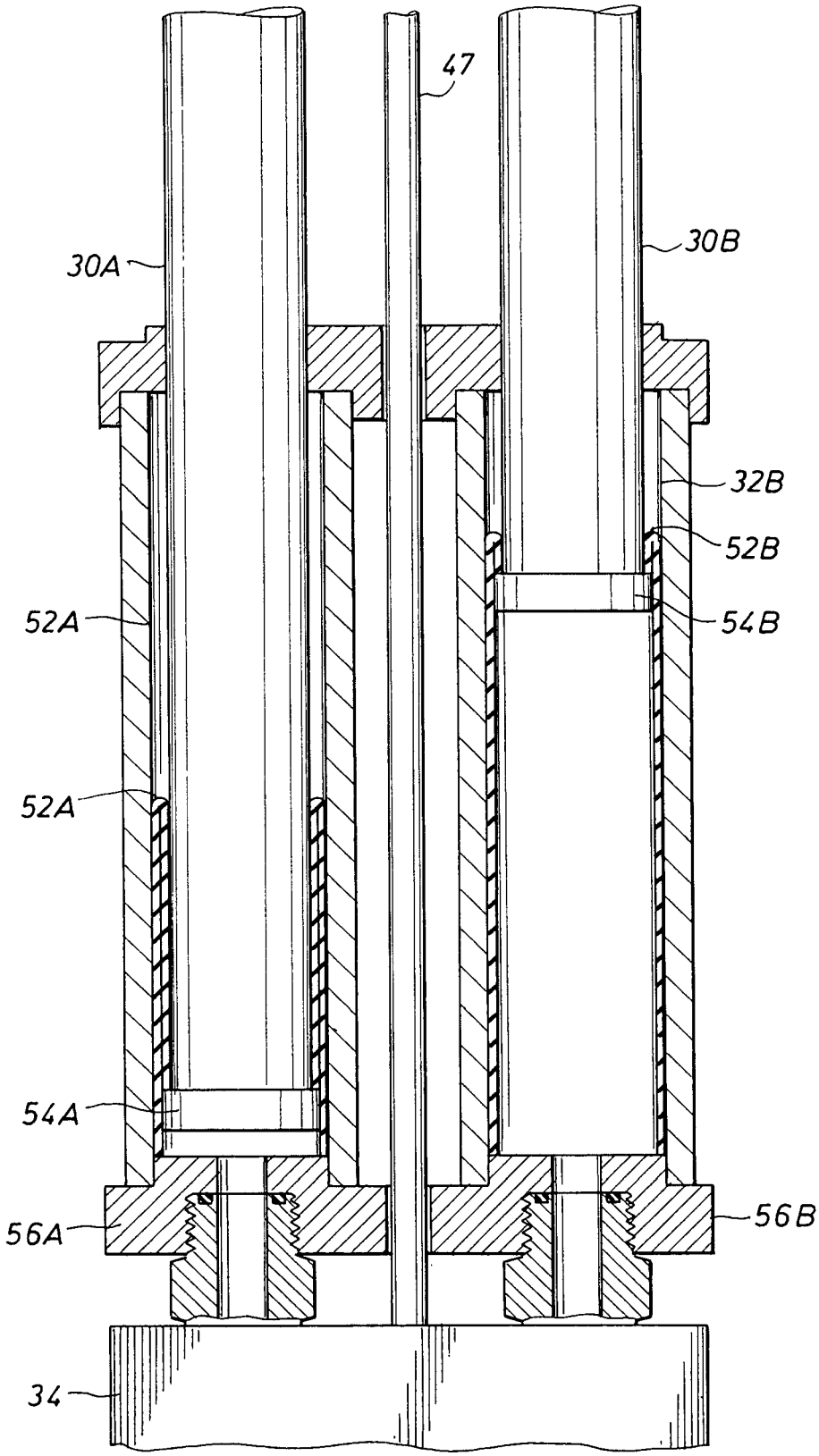
FIG. 2 is an enlarged view of the pumping chambers of the pump of FIG. 1, illustrating dual pumping chambers equipped with tubular diaphragms.

Referring now to FIG. 2, tubular diaphragms (or "bladders") 33A, 33B are disposed between the outer walls of pistons 30A, 30B, respectively, and the inner walls of pumping chambers 32A, 32B. The diaphragms fold into themselves at a fold over point or convolution 52A, 52B. Each tubular diaphragm 33A, 33B is terminated on the piston 30A, 30B by a cap 54A, 54B. Each tubular diaphragm 33A, 33B is terminated on the chamber 32A, 32B side by a housing 56A, 56B. As each piston 30A, 30B moves up and down within its pumping chamber 32A, 32B, the convolution 54A, 54B of the diaphragm 33A, 33B also moves up and down. In FIG. 2, the cap 54A is in a lower position, because piston 30A is near the lower limit of its travel. The cap 54B is in an upper position, because piston 30B is in an upper position.

There is ample clearance between the surfaces of the tubular diaphragms 33A, 33B so as not to cause abrasion. All the surfaces of the diaphragms 33A, 33B are supported by either the cylinder wall or piston wall with exception of the area of the caps 54A, 54B. Because the area of a cap is very small, the thin diaphragm tube can withstand relatively high pressures within the pumping chamber. Further, because pump inlet 62 is flooded from tank 20, the diaphragms 33A, 33B are not subject to collapse due to large suction forces.

Although the preferred arrangement provides the pumping chambers with tubular diaphragms, other non-diaphragm plunger or piston designs may be used depending on the application and characteristics of fluid being pumped. Ideally, the displacement of chambers 32A, 32B is large in order to facilitate operation at a very slow cycle speed of only one to four reciprocations per minute.

Figure 3:
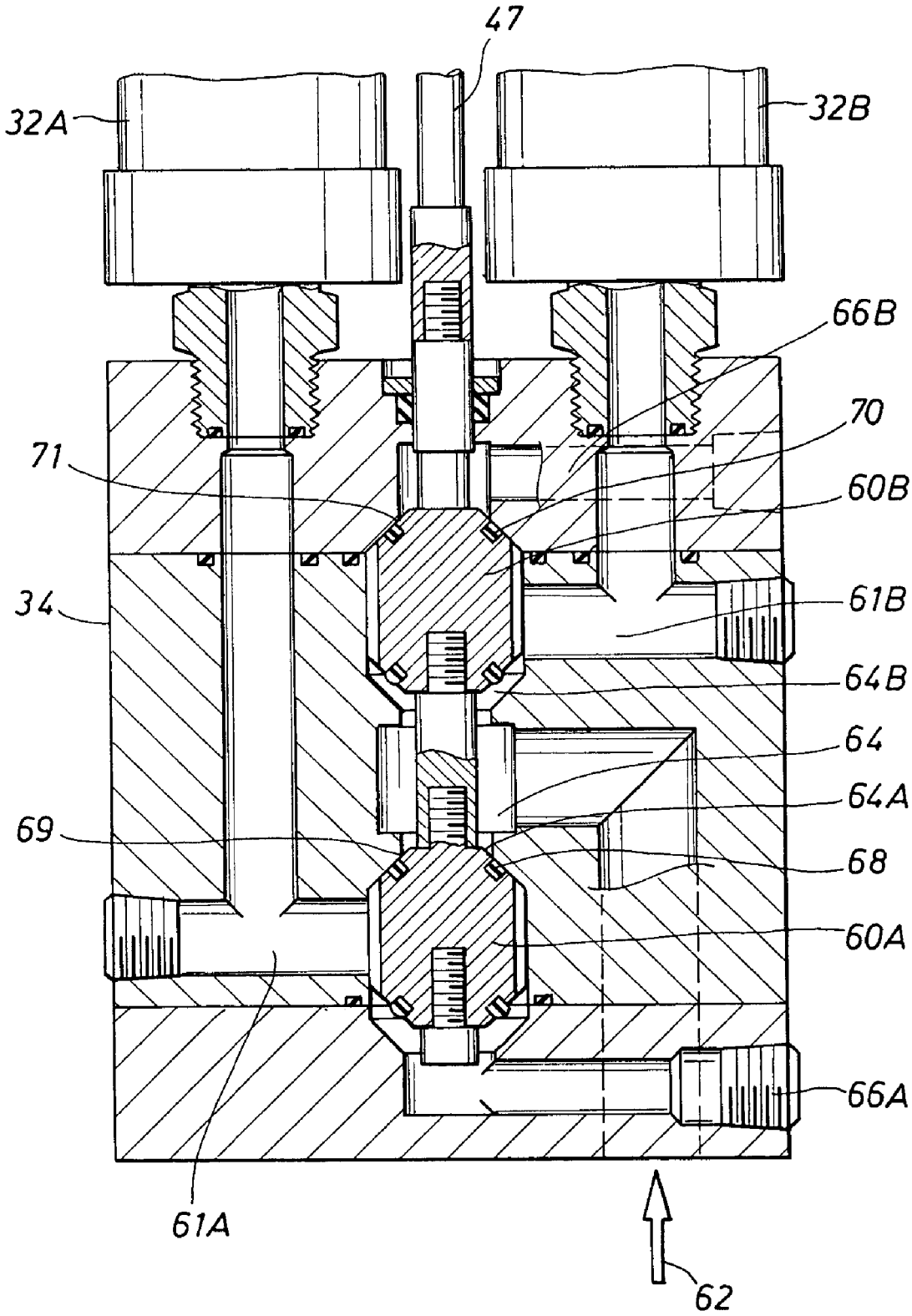
FIG. 3 is an enlarged view of the valve body of the pump of FIG. 1, illustrating dual, tandem-mounted, three-way valves.

FIG. 3 illustrates the valve body 34 with dual three-way, two-position spool valves 60A, 60B, each for sequentially filling and discharging a respective cylinder 32A, 32B. Both valves 60A, 60B are identical and mounted in tandem and operated by a linkage 47 that is placed either in an up position (as illustrated) or a down position. The fluid of tank 20 enters the valve body 34 via common suction port 62 and fills the passage 64 between the two valves 60A, 60B. The input ports for valves 60A and 60B are labeled 64A and 64B respectively.

When the linkage 47 is in its up position, valves 60A, 60B are positioned as shown, with cylinder 32A being in communication with discharge port 66A and with the inlet 62 being in fluid communication with cylinder 32B. Valve 60A is in the discharge position closing inlet 62 because elastomeric seal 68 is forced against annular seat 69. Valve 60B is in the suction position, because elastomeric seal 70 is forced against annular seat 71 thereby closing off the path to discharge outlet 66B and opening the path from suction 62 and passage 64 to cylinder 32B.

While the linkage 47 is in the up position as shown, the cylinder 32B is being filled by the upward movement and suction of plunger 30B, while the cylinder 32A is being discharged by the downward movement and pressure of plunger 30A causing pressurized flow via discharge port 66A. Although not shown in FIG. 3, the discharge ports 66A and 66B are connected to a common manifold 36 as shown in FIG. 1. When the linkage 47 snaps to a downward position, the valve 60A switches substantially instantaneously to a suction position for cylinder 32A while closing passage to the discharge outlet 66A, and the valve 60B switches to a discharge position while closing the suction path from inlet 62 and passage 64.

Figure 4:
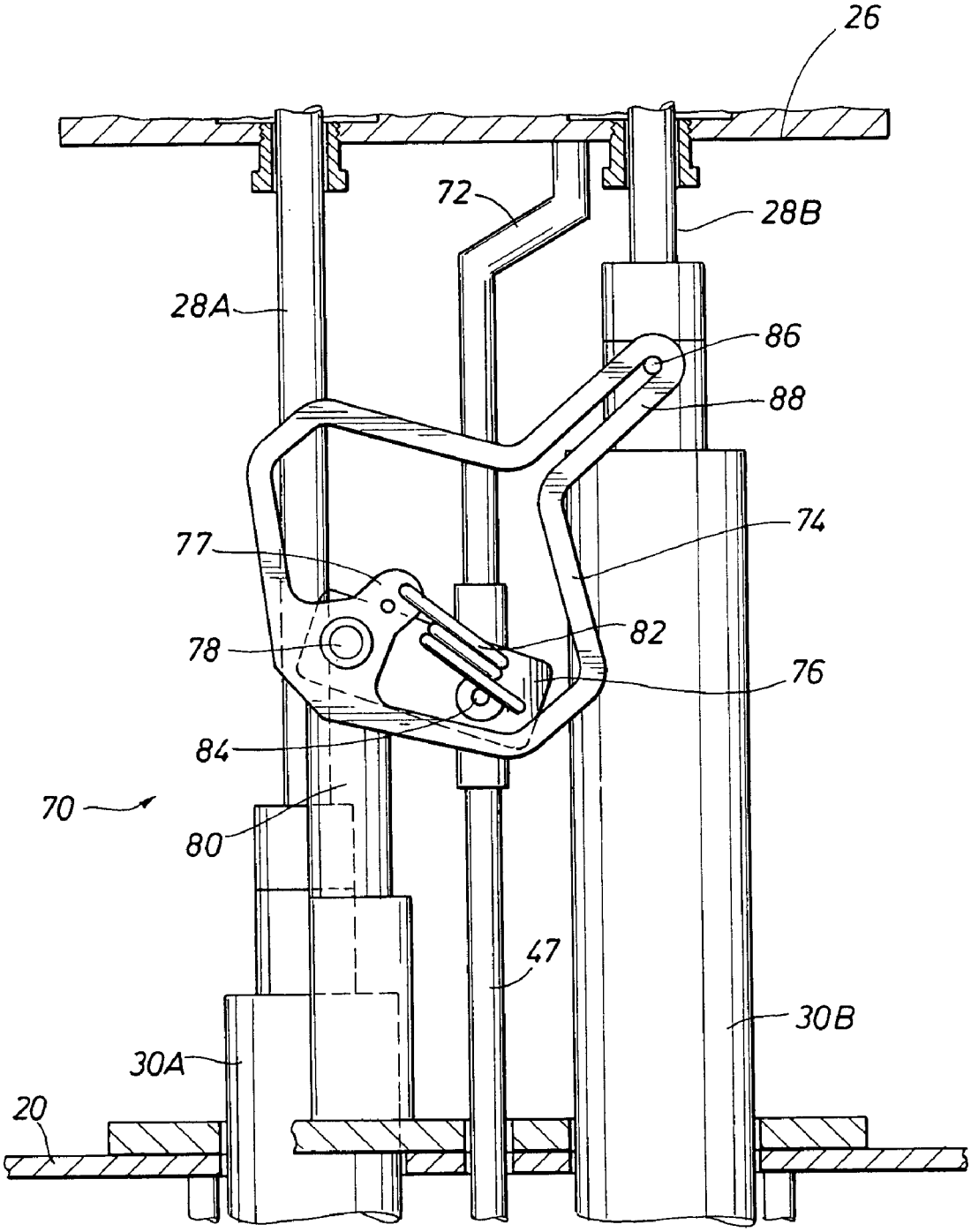
FIG. 4 is an enlarged view of an automatic shifting mechanism of the pump of FIG. 1, showing the valve actuation linkage in the downward position.
Figure 5:
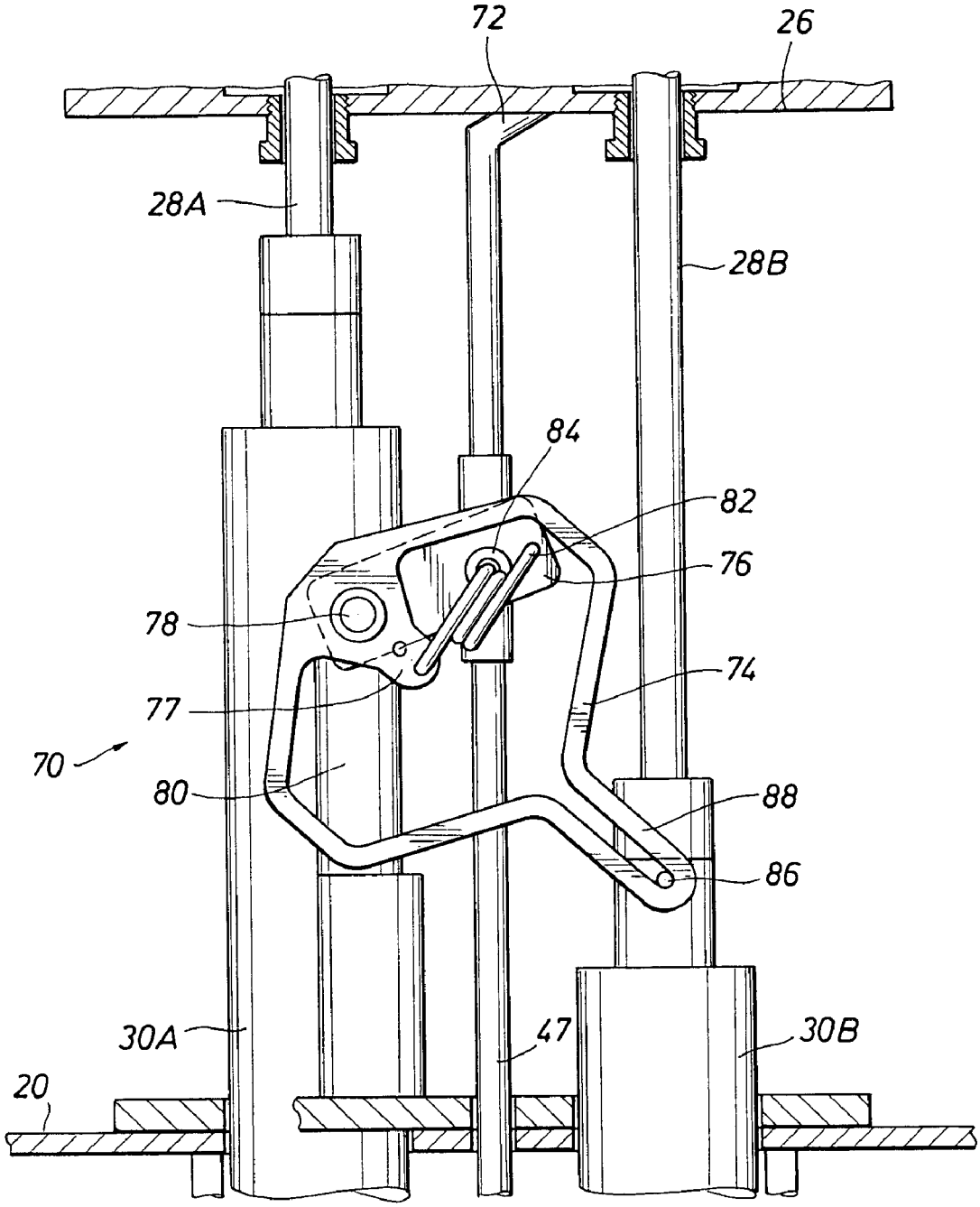
FIG. 5 is an alternate view of FIG. 4 showing the valve actuation linkage in the upward position.

FIGS. 4 and 5 illustrate the automatic shifting mechanism 70 that shifts the tandem valves 60A, 60B in valve body 34 (not shown) via linkage 74. Automatic shifting mechanism 70 also actuates the reversing switch mechanism 94 in enclosure 24 (see FIG. 1) via linkage 72, which results in motor 22 reversing its direction of rotation.

As shown in more detail in FIG. 4, yoke 74 and a lever 76 are commonly mounted on a bushing 78 fixed to a stationary standard 80. The yoke 74 is shown in an upward position. Yoke 74 and lever 76 are free to independently rotate about bushing 78, except that a torsion spring 82 resiliently couples the free end of lever 76 with an internal arm 77 in yoke 74. Spring 82 provides the compressive force to keep valves 60A and 60B (see FIG. 1) tightly seated. The free end of lever 76 is also coupled to linkages 47 and 72 by ball joint connection 84. Pin 86, located at the bottom of lead screw 28B, is captured and slides within a narrow neck 88 of yoke 74 and causes yoke 74 to rotate about bushing 78.

In FIG. 4, lead screw 28B has reached its upper limit of travel, and the yoke 74 has actuated to cause lever 47 and lever 72 to be in the downward position. Stepper motor 22 (see FIG. 1) has reversed and lead screw 28B begins its decent. As pin 86 descends, yoke 74 rotates clockwise about bushing 78, causing internal arm 77 to rotate clockwise. Such clockwise rotation compresses torsion spring 82. The force exerted by torsion spring 82 upon ball joint 84 is still in the downward direction. As lead screw 28B approaches its lowest point of travel, the internal arm 77 is horizontally aligned with ball joint 84 and torsion spring 82 is at maximum compression. Any further downward motion by lead screw 28B causes torsion spring 82 to present an upward force on ball joint 84, which rapidly snaps to its upper position, thereby changing the positions of valves 60A, 60B (See FIG. 1) and causing the "toggle" or reverse switch 94 again to change the direction of motor 22. FIG. 5 shows yoke 74 of the automatic shifting mechanism in a lower position. As lead screw 28B rises, the torsion spring 82 compresses against ball joint 84 in the upward direction until internal arm 77 is horizontally aligned (i.e. reaches minimum distance) with ball joint 84. Ball joint 84, carrying linkages 47 and 72 then snaps back into the downward position, thus completing the cycle.

Figure 6:
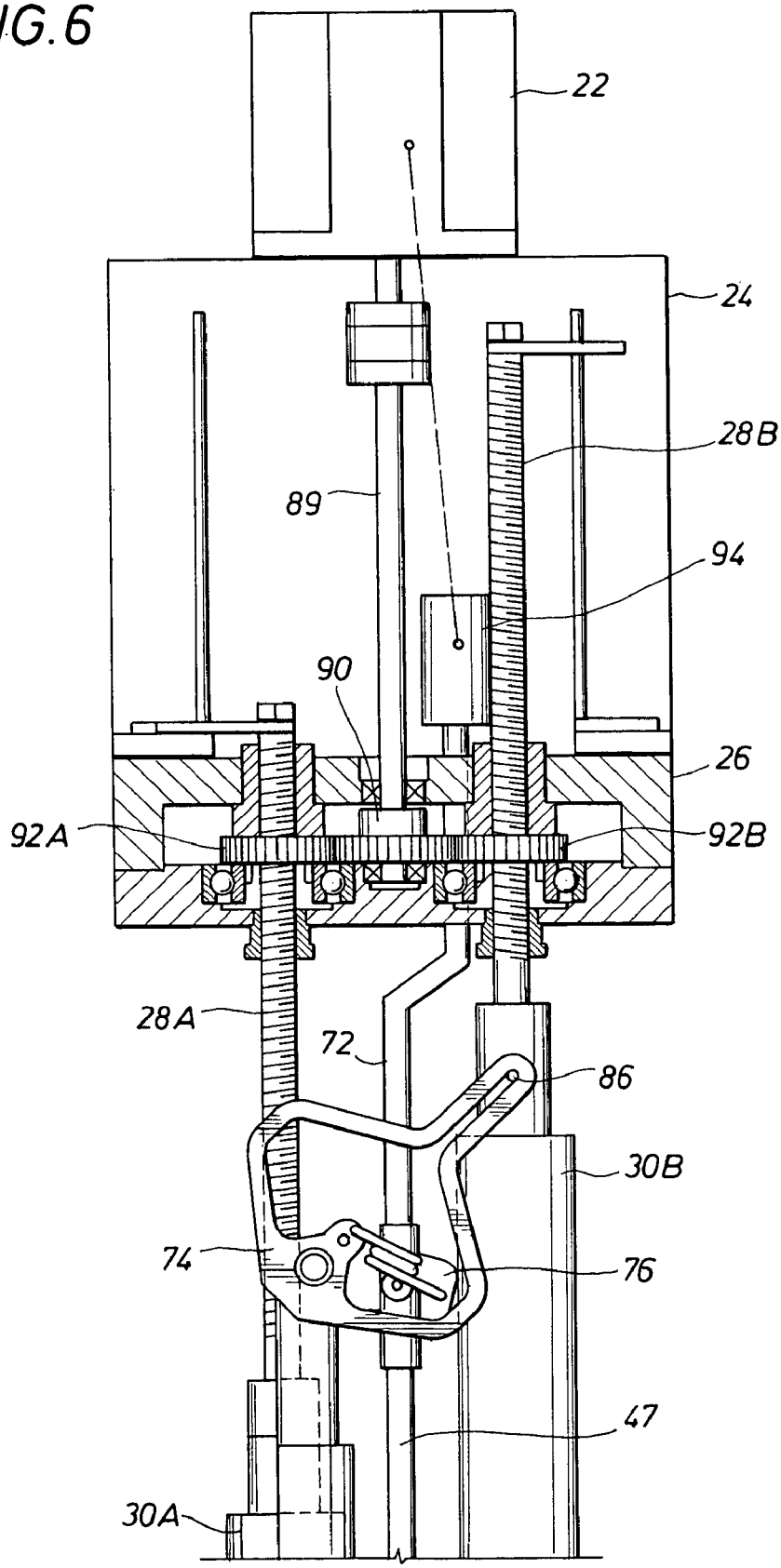
FIG. 6 is an enlarged view of the gear box of the pump of FIG. 1 suitable for use with a reversible drive motor.

FIG. 6 illustrates the preferred embodiment of the dry end of pump 10. A 12 VDC stepping motor 22 is coupled via shaft 89 to locked gear train 90, which meshes with gears 92A and 92B. Gears 92A and 92B both rotate in the same direction. Gears 92A, 92B have internal threads which mate with lead screws 28A, 28B, respectively. Gear 92A and lead screw 28A have opposite-hand threads to gear 92B and lead screw 92B. Thus, lead screws 28A and 28B always move in opposite directions and at the same rate. Linkage 72 actuates the toggle switch 94 which serves to change the direction of motor 22 and shaft 89.

Figure 7A:
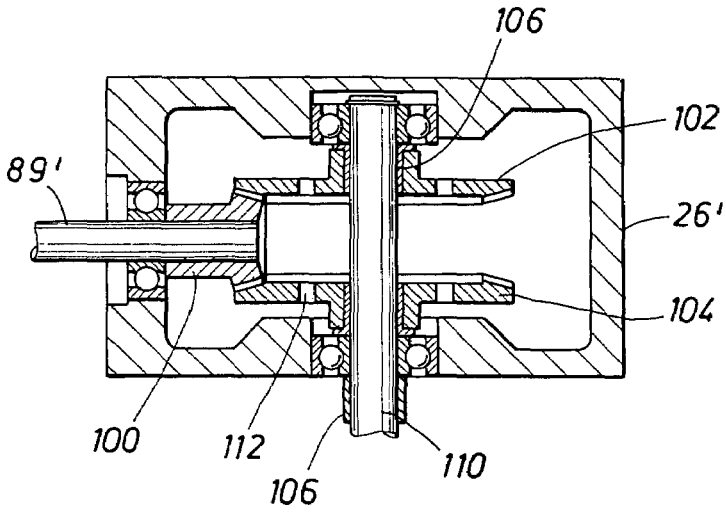
FIGS. 7A and 7B illustrate an alternate gearbox for the pump of FIG. 1 suitable for use with a non-reversible drive motor.
Figure 7B:
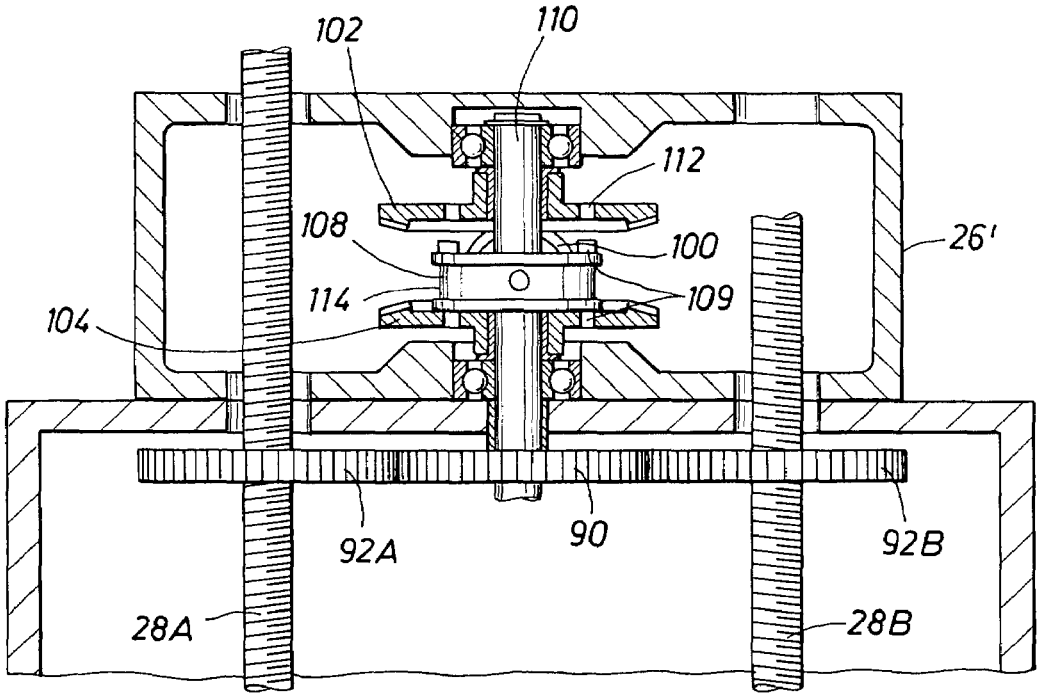

An alternative gear box 26' arrangement is shown in FIGS. 7A and 7B which mechanically, rather than electrically, changes direction of rotation. Such an arrangement is suitable for use with a motor capable of turning in one direction only. In this configuration, a motor (not shown) mounts horizontally to the side of the gear box rather than vertically on top.

FIG. 7A, a side view of gear box 26', illustrates input shaft 89' driving pinion 100 which engages an upper level gear 102 and a lower 104 bevel gear, each freewheeling on hollow bushings 106. Upper bevel gear 102 rotates in an opposite direction to lower bevel gear 104.

FIG. 7B, a front view of gearbox 26', illustrates a clutch 108 with upper and lower pins 109. Clutch 108 rides on a splined shaft 110 and is free to move axially on shaft 110 to engage upper bevel gear 102 or lower bevel gear 104 through engagement of pins 109 into receiving holes 112 in each gear. As clutch 108 engages one or the other gears, the direction of rotation of shaft 110 is changed or reversed. Shaft 110 is coupled to gears 90, 92A, 92B to drive lead screws 28A, 28B. Clutch 108 may be coupled to linkage 72 (see FIG. 6) in several different ways, including being rotatably captured in groove 114 by a forked member attached to linkage 27. Alternatively, clutch 108 can be fixed to shaft 110, with gear 90 coupled to shaft 110 by a spline and vertically fixed relative to gears 92A, 92B, thereby causing shaft 110 to move up and down with linkage 72.

Metering pump 10 is driven by a motor using an external power source. An electric motor is preferred, but it can be driven by an air powered motor. The dual, matched pumping chambers 32A, 32B with tubular diaphragms 33A, 33B operating in parallel, in combination with the mechanically operated valves 60A, 60B provide positive fluid control. The pump is uniquely characterized by the combination of the spring-actuated, snap-action automatic shifting mechanism 70, the bi-directional gearbox 26, and the lead screw actuators 28A, 28B. The configuration of the pump submerged in the fluid that is to be pumped, along with the arrangements described above provides a pumping system with precise metering capabilities that reduces problems associated with fluid metering such as high viscosity, cavitation, air induced suction conditions, off gassing of volatile fluids, inefficiency at slow speeds, pulsation, solids in the medium being pumped, and corrosion to sealing components such as pistons and plungers.

While preferred embodiments of the invention have been illustrated in detail, modifications and adaptations of the preferred embodiments will occur to routineers in the art of pump design. Such modifications and adaptations are in the spirit and scope of the invention as set forth in the following claims:

What is claimed is:

1. A metering pump (10) comprising, a first cylinder (32A) having a first cylinder lower end and a first cylinder upper end, a first piston (30A) designed and arranged for reciprocation within said first cylinder and having a first piston lower end (54A) disposed in said first cylinder and a first piston upper end extending above said first cylinder upper end, a first three-way valve assembly (60A) having a first inlet port (64A), a first common port (61A) and a first outlet port (66A) with said first common port (61A) fluidly coupled to said first cylinder lower end, said first three-way valve assembly arranged and designed to allow fluid entry into said first cylinder lower end through said first inlet port (64A) and said common port (61A) and allow fluid exit from said first cylinder lower end through said common port (61A) and said first outlet port (66A), a first tubular diaphragm (33A) having a first diaphragm upper end sealingly coupled to said first piston lower end and a first diaphragm lower end sealingly coupled to said first cylinder lower end, with a convolution (52A) between said first diaphragm upper end and said second first diaphragm lower end, a second cylinder (32B) having a second cylinder lower end and a second cylinder upper end, a second piston (30B) designed and arranged for reciprocation within said second cylinder (32B) and having a second piston lower end disposed in said second cylinder (32B) and a second piston upper end extending above said second cylinder end, a second three-way valve assembly (60B) having a second inlet port (64B), a second common port (61B) and a second outlet port (66B) with said second common port (61B) fluidly coupled to said second cylinder lower end, said second three-way valve assembly arranged and designed to allow fluid entry into said second cylinder lower end through said second inlet port (64B) and said common port (61B) and allowing fluid exit from said second cylinder lower end through said common port (61B) and said second outlet port (66B), a second tubular diaphragm (33B) having a second diaphragm upper end sealingly coupled to said second piston lower end and a second diaphragm lower end sealingly coupled to said second cylinder lower end, with a convolution (52B) between said second diaphragm upper end and said second diaphragm lower end, a motor (22) with a linkage coupled to said first piston upper end, to said second piston upper end, to said first valve assembly and to said second valve assembly, whereby said first and second pistons (30A, 30B) are arranged to reciprocate in opposite directions within respective said first and second cylinders (32A, 32B), and said first valve assembly opens said first inlet port (64B) and closes said first outlet port (66A) while said first piston (30A) is moving upward in said first cylinder (32A) and said first valve assembly closes said first inlet port (64A) and opens said first outlet port (66A) while said first piston (30A) is moving downward in said first cylinder (32A), and said second valve assembly opens said second inlet port (64B) and closes said second outlet port (66B) while said second piston (30B) is moving upward in said second cylinder (32B) and said second valve assembly closes said second inlet port (64B) and opens said second inlet port (66B) while said second piston (30B) is moving downward in said second cylinder (32B).

2. The metering pump (10) of claim 1 further comprising, a first cap (54A) fixing said first diaphragm (33A) upper end to said lower end of first said piston (30A), and a second cap (54B) fixing said second diaphragm (33B) upper end to said lower end of said second piston (30B).

3. The metering pump (10) of claim 1 further comprising, a first housing (56A) fixing said first diaphragm (33A) lower end to said first cylinder lower end, and a second housing (56B) fixing said second diaphragm (33B) lower end to said second cylinder lower end.

4. The metering pump (10) of claim 1 wherein said motor is an electric motor (22).

5. The metering pump (10) of claim 4 wherein said electric motor (22) is a two direction motor and said linkage includes a switching device for changing the direction of rotation of said motor.

6. The metering pump (10) of claim 4 wherein said electric motor (22) is a single directional motor.

7. A metering pump (10) comprising, a first cylinder (32A), a first piston (30A) designed and arranged for slidable and dynamically sealed movement within said first cylinder and having a lower end disposed in said first cylinder (32A) and an upper end extending above said first cylinder, a first three-way valve (60A) having a first inlet port (64A), a first common port (61A) and a first outlet port (66A) with said first common port (61A) fluidly coupled to a lower end of said first cylinder (32A), said first three-way valve having a suction position wherein said first common port (61A) is fluidly coupled only to said first inlet port (64A), and a discharge position wherein said first common port (61A) is fluidly coupled only to said first outlet port (66A), a second cylinder (32B), a second piston (30B) designed and arranged for slidable and dynamically sealed movement within said second cylinder (32B) and having a lower end disposed in said second cylinder (32B) and an upper end extending above said second cylinder, a second three-way valve (60B) having a second inlet port (64B), a second common port (61B) and a second outlet port (66B) with said second common port (61B) fluidly coupled to a lower end of said second cylinder (32B), said second three-way valve (60B) characterized by having a suction position wherein said second common port (61B) is fluidly coupled only to said second inlet port (64B), and a discharge position wherein said second common port (61B) is fluidly coupled only to said second outlet port (66B), a motor (22), a transmission mechanism coupled between said motor (22) and said upper end of said first piston (30A) and said upper end of said second piston, said transmission mechanism arranged and designed to transfer rotative motion from said motor (22) into reciprocating motion of said first piston (30A) in said first cylinder (32A) and simultaneous oppositely directed reciprocating motion of said second piston (30B) within said second cylinder (32B), an actuator linkage (47, 70) coupled to said transmission mechanism (26, 28A, 28B) and to said first and second three-way valves (60A, 60B), said actuator linkage when placed in a first position arranged to seat said first three-way valve (60A) in said suction position and said second three-way valve (60B) in said discharge position when said second piston (30B) is moving downward in said second cylinder (32B) and said first piston (30A) is moving upward in said first cylinder (30A), and said actuator linkage when placed in a second position arranged to seat said first three-way valve (60A) in said discharge position and said second three-way valve (60B) in said suction position when said second piston (30B) is moving upward in said second cylinder (32A) and said first piston (30A) is moving downward in said first cylinder (30A), and a switching mechanism (70) coupled to at least one of said first and second pistons and which is designed and arranged to reverse angular direction of said rotative motion of said motor, thereby reversing reciprocating direction of said first and second pistons (30A, 30B).

8. The metering pump (10) of claim 7 wherein said switching mechanism (70) is a snap action arrangement designed to cause a substantially instantaneous change of angular direction of said rotative motion of said motor with a concurrent substantially instantaneous switching of said valve actuator linkage between said first and second positions.

9. The metering pump (10) of claim 8 wherein, said snap action arrangement includes, a pin (86) connected to a top end of said second piston (30B), a yoke (74) having a neck (88) which slidably captures said pin (86), and an arm (77), said yoke being rotatably coupled about a fixed point (78), and a lever (76) resiliently coupled between said actuator linkage (47, 70) and said arm (76) of said yoke, whereby when said second piston (30B) moves to a downward position, said lever (76) snaps to an upper position within said yoke (74) thereby causing said actuator linkage to snap to an upper position, and vice versa.

10. The metering pump (10) of claim 7 wherein, said first inlet port (64A) and said second inlet port (64B) are fluidly coupled.

11. The metering pump (10) of claim 7 wherein, said first outlet port (66A) and said second outlet port (66B) are fluidly coupled to form a common discharge line (36).

12. The metering pump of (10) claim 11 further comprising, a flow meter (38) fluidly coupled to said common discharge line (36).

13. The metering pump (10) of claim 7 further comprising, a remotely mounted control panel (12), electrically coupled to said motor (22) and said flow meter (38) and designed and arranged for control of said motor by differencing a flow rate signal from said flow meter (38) with a signal representative of a desired flow rate and sending a signal to said motor in response to a difference.

14. The metering pump (10) of claim 7 further comprising, a tank (20), with said first inlet port (64A) and said second inlet port (64B) disposed in said tank.

15. The metering pump (10) of claim 7 wherein, said switching mechanism includes a toggle switch (94) connected to said actuator linkage (47, 72) and electrically coupled to said motor (22) for reversing direction of rotation of said motor (22).

* * * * *